US006585536B1

(12) United States Patent
Wu

(10) Patent No.: US 6,585,536 B1
(45) Date of Patent: Jul. 1, 2003

(54) CABLE END CONNECTOR WITH LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/241,551

(22) Filed: Sep. 11, 2002

(51) Int. Cl.[7] ..... H01R 13/627
(52) U.S. Cl. ..... 439/358
(58) Field of Search ..... 439/358, 357, 439/352, 353, 606

(56) References Cited

U.S. PATENT DOCUMENTS

| | | | | |
|---|---|---|---|---|
| 5,445,534 A | | 8/1995 | Ishizuka et al. | 439/353 |
| 5,716,228 A | * | 2/1998 | Chen | 439/358 |
| 5,727,963 A | * | 3/1998 | LeMaster | 439/358 |
| 5,749,746 A | * | 5/1998 | Tan et al. | 439/357 |
| 5,775,931 A | | 7/1998 | Jons | 439/358 |
| 5,876,232 A | * | 3/1999 | Matsushita et al. | 439/357 |
| 5,924,886 A | | 7/1999 | Achammer et al. | 439/372 |
| 5,938,470 A | * | 8/1999 | Kashiyama | 439/489 |
| 5,941,726 A | * | 8/1999 | Koegel et al. | 439/358 |
| 5,971,790 A | * | 10/1999 | Rohde | 439/357 |
| 6,099,339 A | * | 8/2000 | Yanagida et al. | 439/358 |
| 6,132,234 A | * | 10/2000 | Waidner et al. | 439/358 |
| 6,203,353 B1 | * | 3/2001 | Huang et al. | 439/352 |

* cited by examiner

*Primary Examiner*—Tulsidas Patel
(74) *Attorney, Agent, or Firm*—Wei Te Chung

(57) ABSTRACT

A cable end connector (10) for mating with a complementary connector (20) comprises a housing (12), a plurality of contacts (132) mounted in the housing, a cable (14) having a plurality of conductors (142) electrically connecting the contacts, a cover (15) over-molded with and enclosing a rear end of the housing, and a locking member (16) mounted to the housing and the cover. The housing defines a retention portion (121) on an upper surface of the housing. The locking member has a main portion (160) abutting against a top surface of the cover, a latch portion (162) extending from the main portion and latching with the retention portion of the housing, and a locking portion (166) extending forwardly from the main portion to lock with the complementary connector for providing a mechanical connection therebetween.

22 Claims, 12 Drawing Sheets

CABLE END CONNECTOR WITH LOCKING MEMBER

CROSS-REFERENCE TO RELATED APPLICATION

This patent application is a co-pending application of the U.S. patent application with an known serial number filed on the same day and by the same inventor, entitled "ELECTRICAL CONNECTOR WITH LOCKING MEMBER" and assigned to the same assignee of this patent application.

BACKGROUND OF THE INVENTION

1. Field of the Invention

The present invention relates to a cable end connector with a locking member for locking with a complementary connector.

2. Description of Related Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary latches for locking the connectors together when mated. U.S. Pat. Nos. 5,445,534, 5,775,931, and 5,924,886 disclose different forms of latch structures to provide reliable mechanical connection therebetween.

There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations, and it is more desirable for the Serial ATA connector to have a locking member for providing a reliable mechanical connection with a complementary connector.

Hence, an electrical connector with a locking member for locking the connector with a complementary connector is required to overcome the disadvantages of the related art.

SUMMARY OF THE INVENTION

An object, therefore, of the present invention is to provide a cable end connector with a locking member for locking the connector with a complementary connector.

Another object of the present invention is to provide a cable end connector with a locking member adapted to easily lock/release with/from a complementary connector.

In order to achieve the objects set forth, a cable end connector for mating with a complementary connector comprises a housing, a plurality of contacts mounted in the housing, a cable having a plurality of conductors electrically connecting the contacts, a cover over-molded with and enclosing a rear end of the housing, and a locking member mounted to the housing and the cover for locking with the complementary connector. The housing forms a retention portion on an upper surface of the housing. The locking member has a main portion abutting against a top surface of the cover, a latch portion extending from the main portion and latching with the retention portion of the housing, and a portion extending forwardly from the main portion in order to lock with the complementary connector for providing a mechanical connection therebetween.

Other objects, advantages and novel features of the invention will become more apparent from the following detailed description when taken in conjunction with the accompanying drawings.

DETAILED DESCRIPTION OF THE INVENTION

Figure 1:
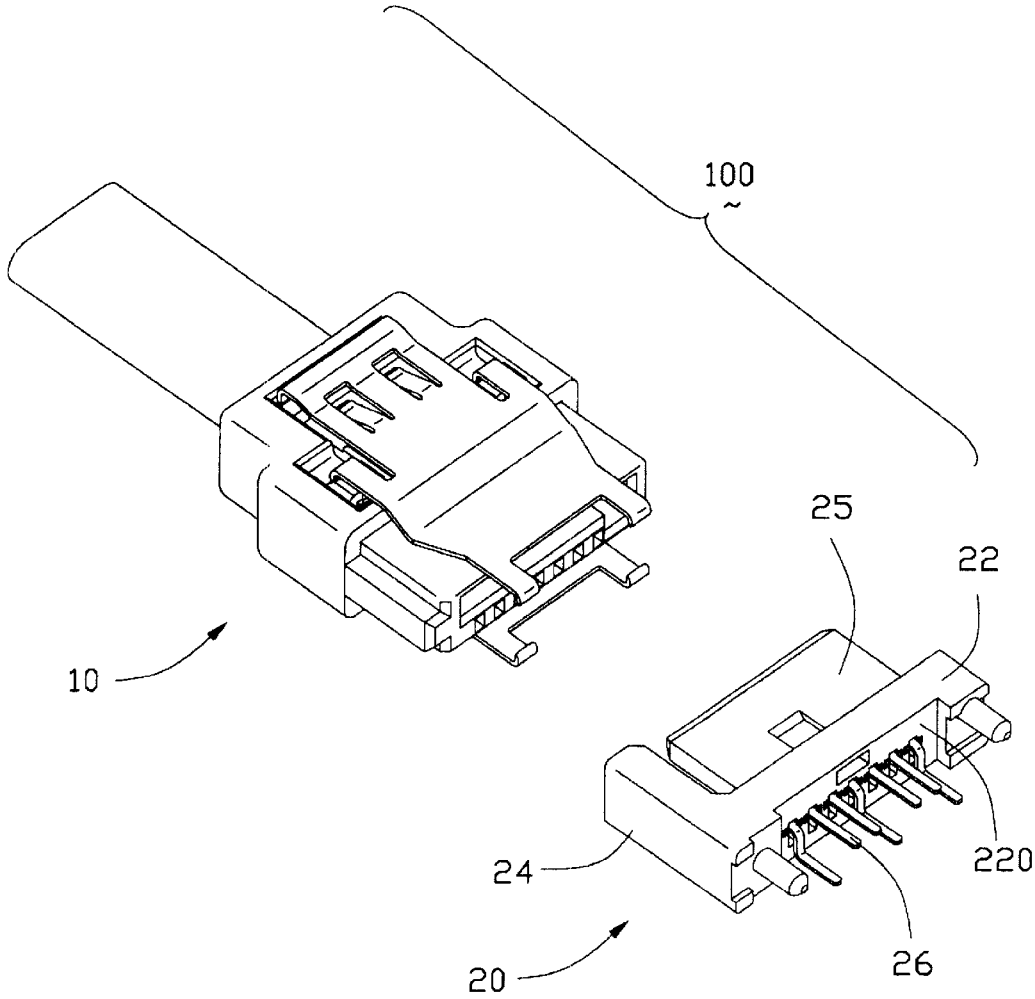
FIG. 1 is an assembled view of an electrical connector assembly to cable end connector and a complementary connector in accordance with the invention.

Referring to FIG. 1, an electrical connector assembly 100 in accordance with the present invention comprises a cable end connector 10 and a complementary connector 20. In the embodiment shown, the cable end connector 10 and the complementary connector 20 are typical standard Serial ATA connectors. However, in alternative embodiments, the electrical connectors could be provided as other than Serial ATA electrical connectors.

Figure 2:
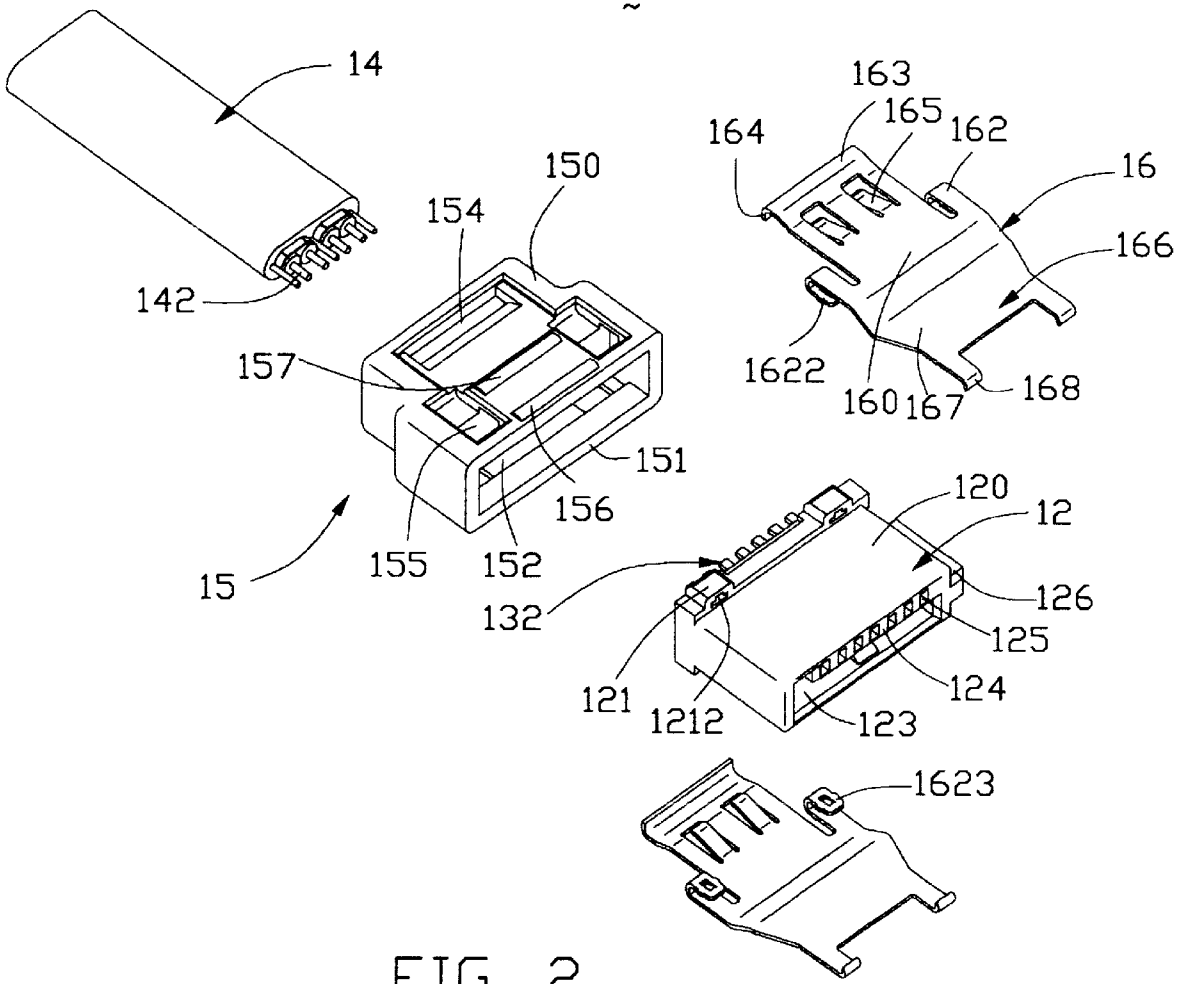
FIG. 2 is an exploded, perspective view of the cable end connector in accordance with the present invention.
Figure 3:
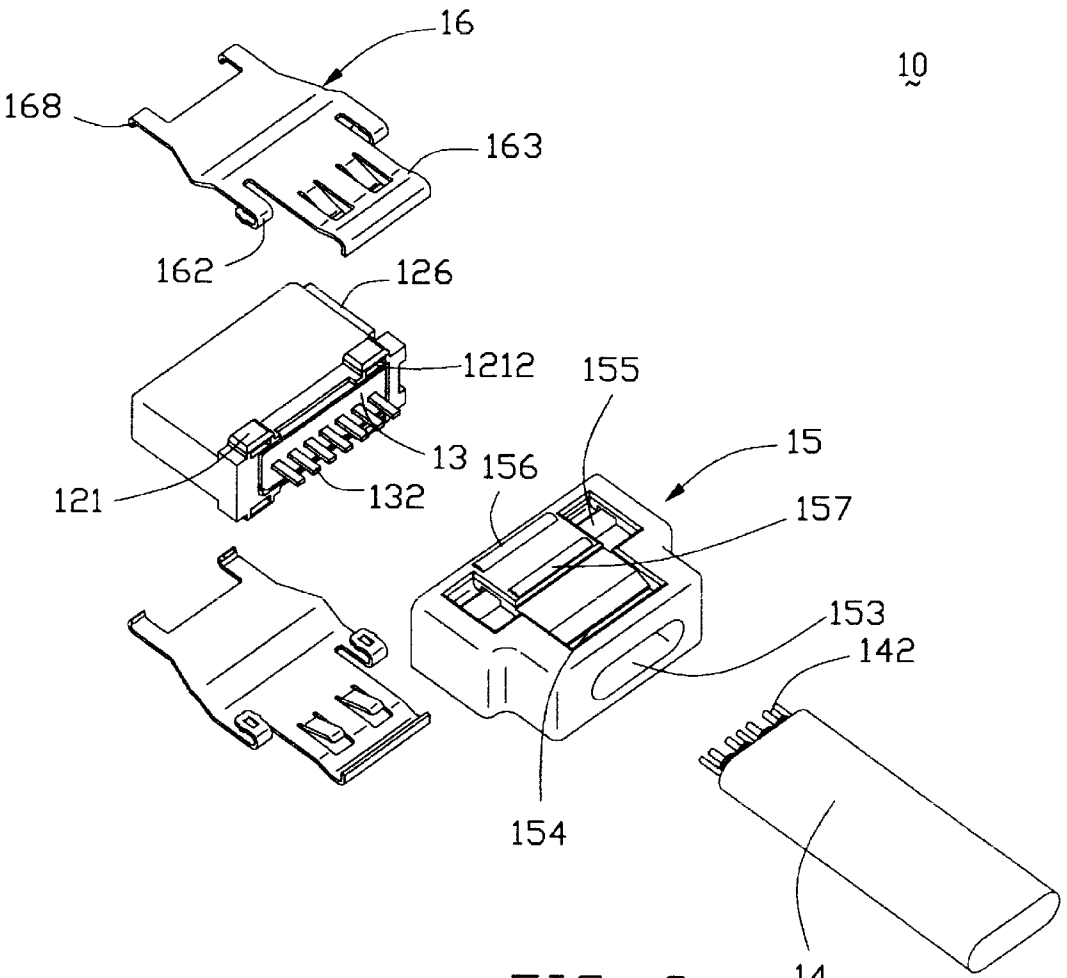
FIG. 3 is a view similar to FIG. 2, but taken from rear and bottom aspects.
Figure 4:
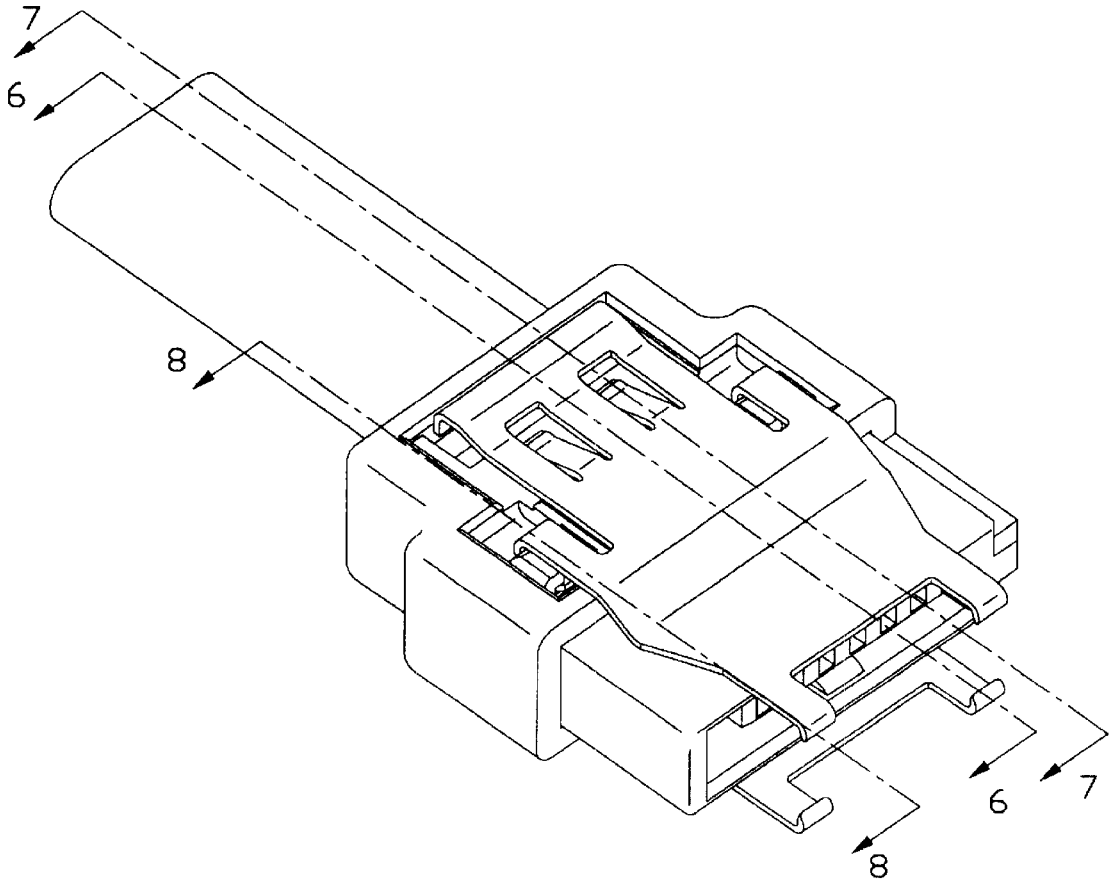
FIG. 4 is an assembly, perspective view of the cable end connector of FIG.2.
Figure 5:
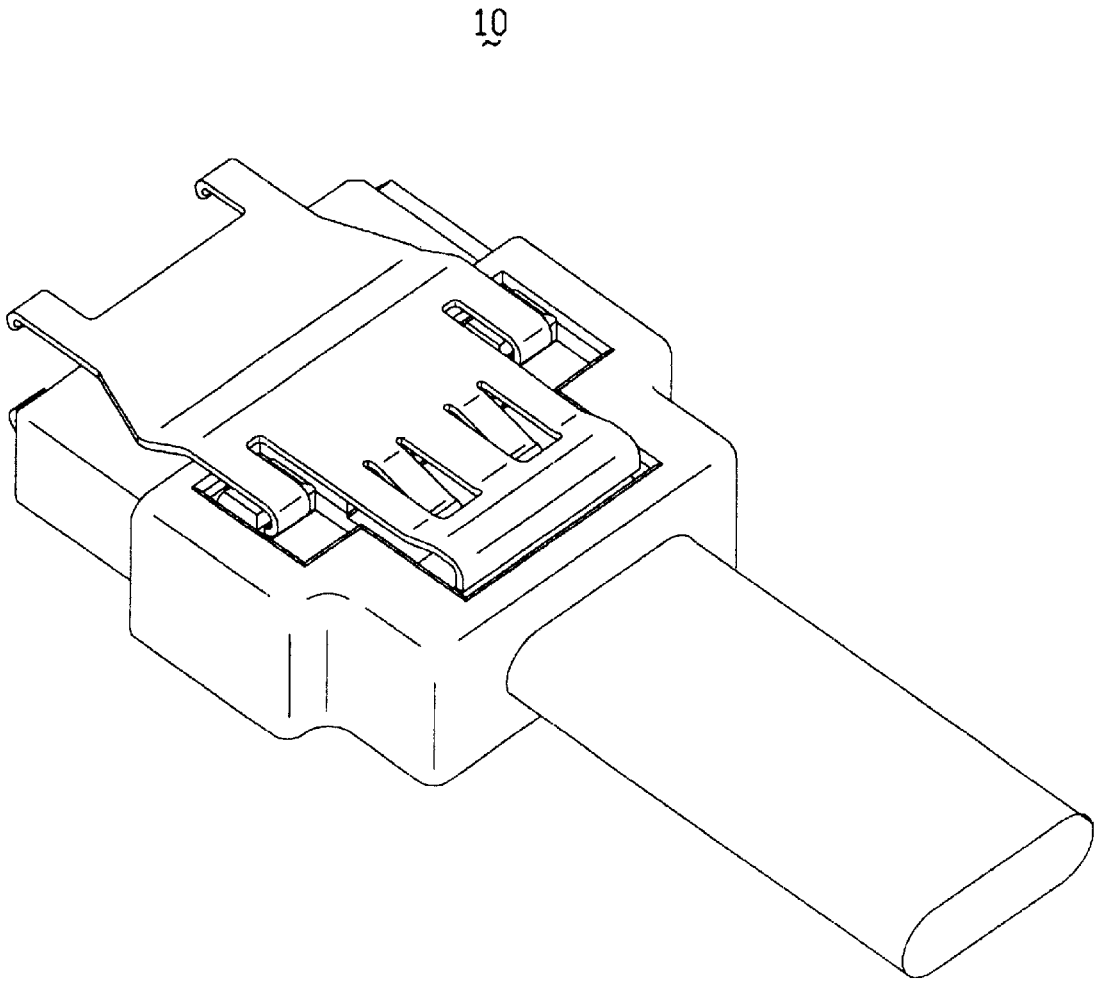
FIG. 5 is a view similar to FIG. 4, but taken from rear and bottom aspects.
Figure 6:
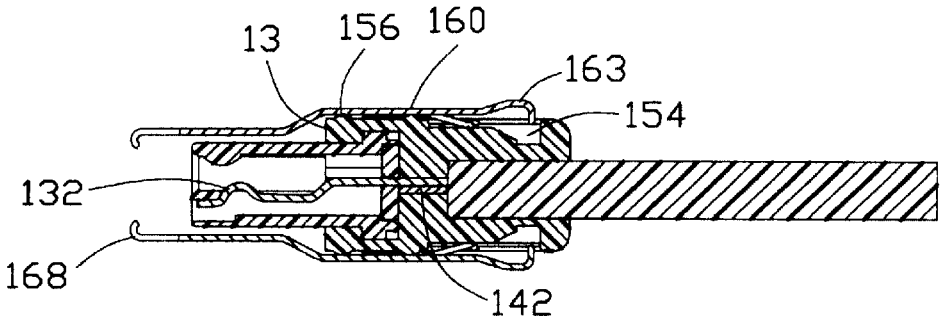
FIG. 6 is a cross-sectional view taken along line 6—6 of FIG. 4.
Figure 7:
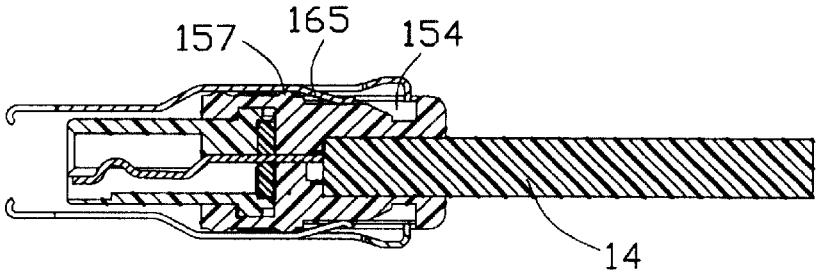
FIG. 7 is a cross-sectional view taken along line 7—7 of FIG. 4.
Figure 8:
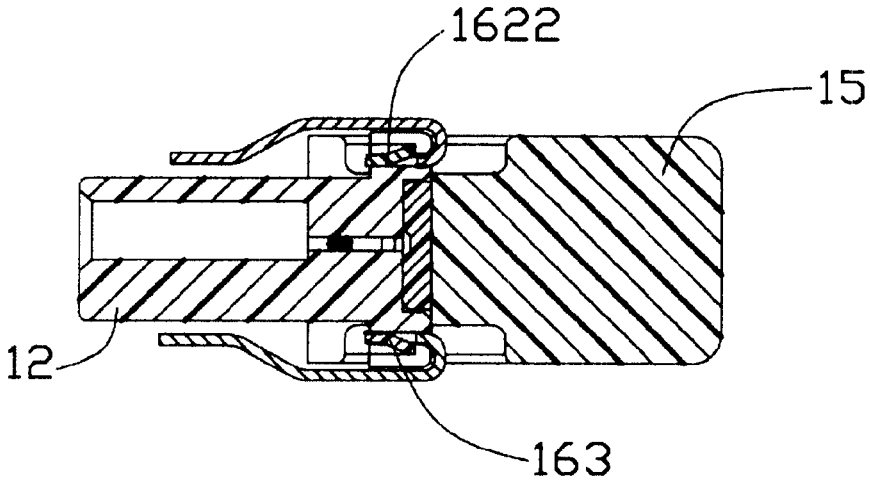
FIG. 8 is a cross-sectional view taken along line 8—8 of FIG. 4.

Referring to FIGS. 2 and 3, the cable end connector 10 comprises an insulative housing 12, a contact insert 13, a cable 14, a cover 15, and a pair of locking members 16.

The housing 12 comprises an L-shaped receiving space 123 defined in a front end thereof and a block 124 protruding into the receiving space 123. The block 124 comprises a plurality of passageways 125 defined in the block 124. Two pairs of retention portions 121 protrude upwardly and downwardly from an upper surface and a lower surface of the housing 12 and adjacent to a rear end of the housing 12. A retention hole is defined in each retention portion 121 in a front to rear direction. A guiding projection 126 protrudes sidewardly from a side surface of the housing 12.

The contact insert 13 is insert-molded with a plurality of contacts 132 and is mounted into a rear end of the housing 12 with the contacts received into the passageways 125 and partly exposed into the receiving space 123.

The cable 14 comprises a plurality of conductors 142 extending beyond a front end thereof.

The cover 15 is over-molded with the housing 12. The cover 15 comprises an upper plate 150 and an opposite lower plate 151 which together defines a receiving cavity at a front end thereof, an opening 153 at a rear end of the cover 15. A recess 154 is defined in the upper plate 150 adjacent to the rear end thereof. A pair of through holes 155 is defined in the upper plate adjacent to the front end of the cover 15 and a pair opposite sides of the cover 15. A first rib 156 is formed on the upper plate 150 adjacent to the front end of the cover 15, and a second rib 157 is formed on the upper plate 150 at a middle of the cover 15. The lower plate 151 of the cover 15 has a same construction with the upper plate 150.

Each locking member 16 comprises a main portion 160, a pair of latching portions formed on a pair of opposite ends of the main portion 160, a push portion 163 extending rearwardly from the main portion 160, and a locking portion extending forwardly from the main portion 160.

Each latching portion 162 extends rearwardly from the main portion 160 and comprises an engaging portion 1622 extending downwardly and forwardly therefrom. A resilient tab 1623 extends downwardly from the engaging portion 1622. A pair of tabs 165 extends downwardly from the main portion 160. The push portion 163 extends upwardly from the main portion and comprises a contact portion 164 extending downwardly from the push portion 163. The locking portion 166 comprises a plate portion 167 extending from the main portion 160 and a pair of locking sections 168 extending forwardly from the plate portion 167. The locking section has a claw construction.

Referring to FIGS. 4–8, in assembly, the conductors 142 of the cable 14 are first soldered to the contacts 132 exposed outside the housing 12. The cover 15 is over-molded with the rear end of the housing 12 with the conductors 142 received into the opening 153, the retention portions 121 entering into the through holes 155 of the upper and lower plates 150 and 151. The pair of locking members 16 are assembled to the housing 12 and the cover 15 with each engaging portion 1622 received into the retention holes 1212 of the retention portion 121, the resilient tab 1623 abuts against an inner wall of the retention hole 1212 of the retention portion 121, the main portion 160 abutting against the first and second ribs 156 and 157, the tabs 165 abutting against the upper and lower plates 150 and 151, the plate portions 167 covering the front end of the housing and the locking sections extending beyond a front surface of the housing 12.

Figure 9:
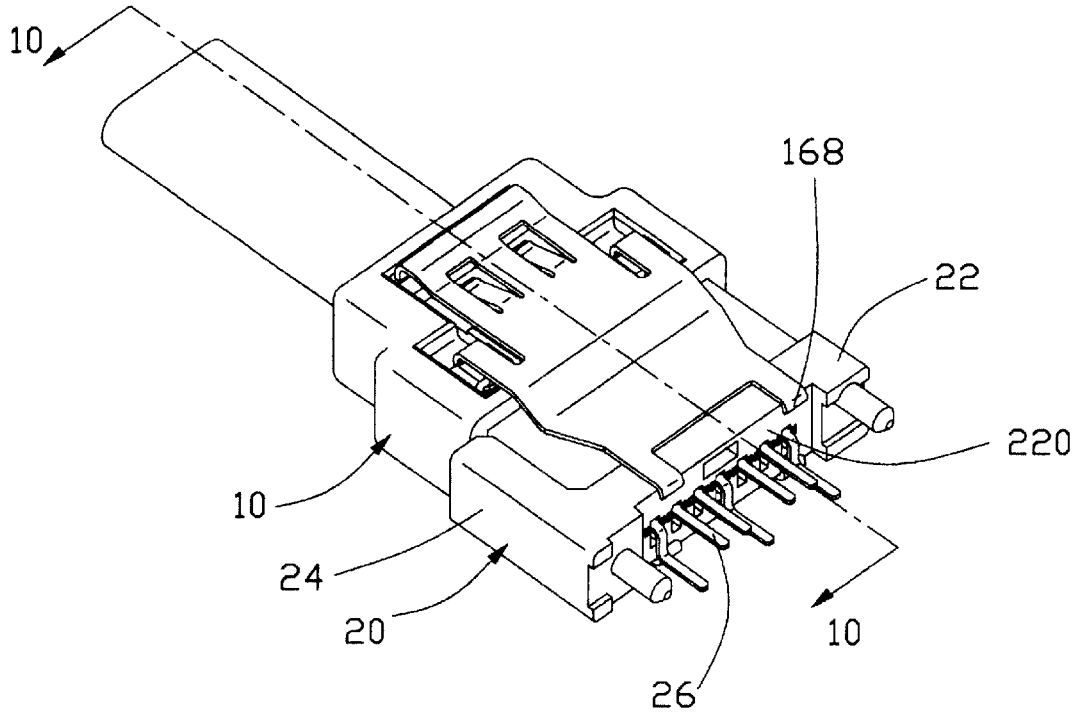
FIG. 9 is an assembled view of FIG. 1.
Figure 10:
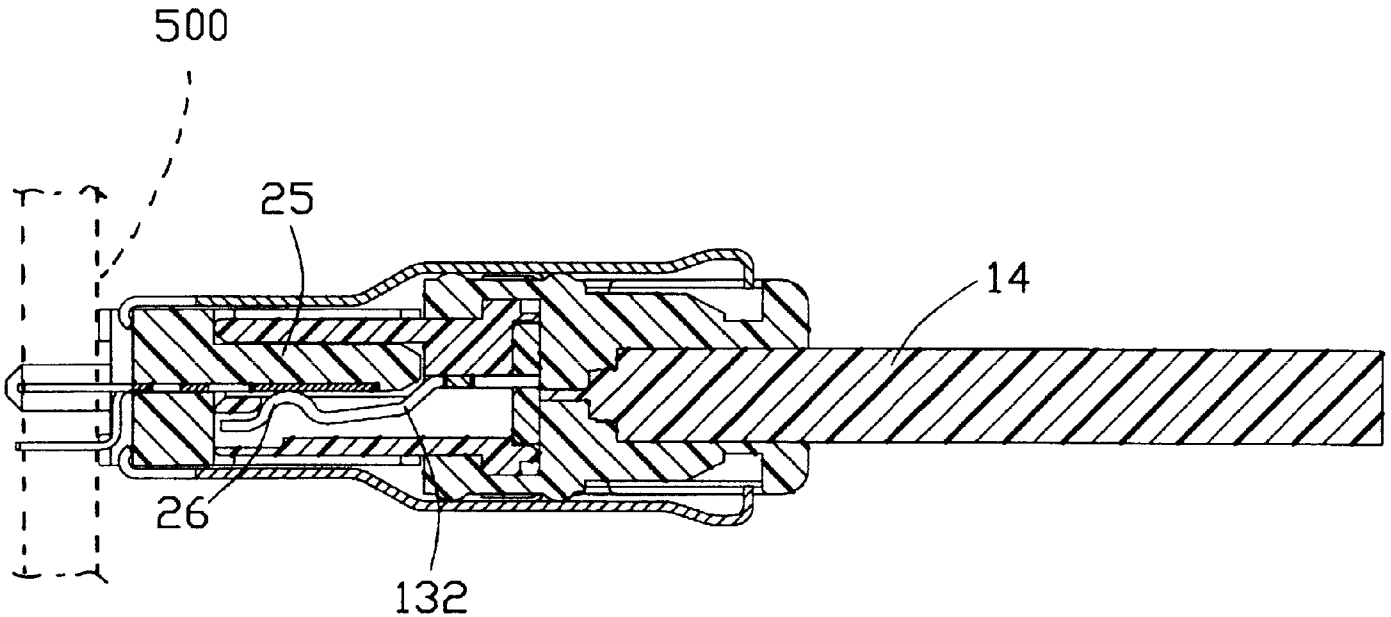
FIG. 10 is a cross-sectional view taken along line 10—10 of FIG. 9.

Referring to FIGS. 1, 9 and 10, the complementary connector 20 comprises a base portion 22, a guiding post 24 extends forwardly from one end of the base portion 22, a tongue portion 25 extending forwardly from a middle of the base portion 22. A plurality of terminals 26 is assembled to the tongue portion and each terminal has a tail portion extending beyond a rear surface 220 of the base portion 22 for extending through and soldered with a through hole of a printed circuit board 500 (FIG. 10).

When the cable end connector 10 is mated with the complementary connector 20, the guiding projection 126 is received into the guiding post 24 of the base portion 22, the tongue portion 25 is received into the receiving space 123 with the terminals 26 electrically contacting the contacts 132, the latching sections 168 locking and abutting against the rear surface 220 of the base portion to securely locking the complementary connector 20 with the cable end connector 10. When the cable end connector is separated from the complementary connector 20, the push portions 163 is pushed toward the cover with the tabs 165 resiliently deformed, the contact portions 164 are received into the recesses 154 of the cover, the second ribs 157 support the main portion 160 and functioning as a fulcrum, at a same time, the locking sections 168 move upwardly and downwardly and are separated from the rear surface of the base portion 22. When the push portions are released, the resilient deform is disappeared, the first ribs 156 support the main portion 160 and functioning as a fulcrum, and at the same time, the push portions and the locking sections return to original positions.

Figure 11:
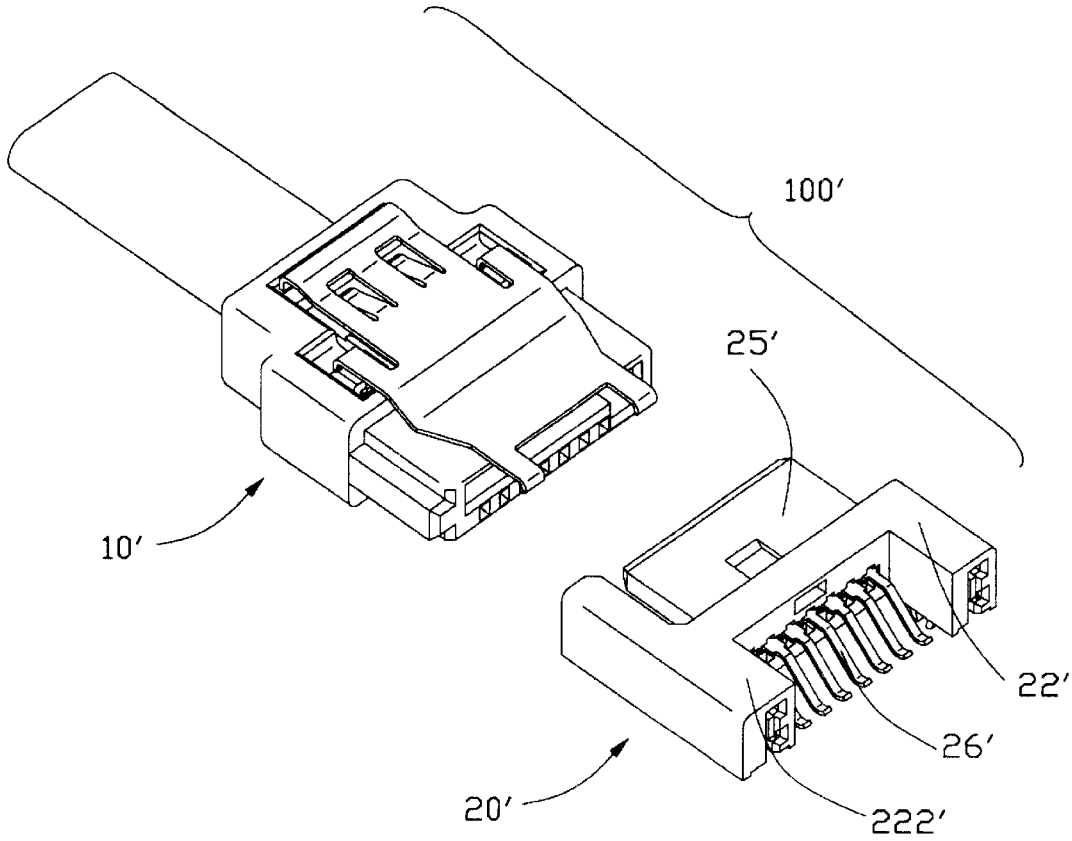
FIG. 11 is an assembled view of an electrical connector assembly of a second embodiment of the present invention to show the cable end connector and a second complementary connector.
Figure 12:
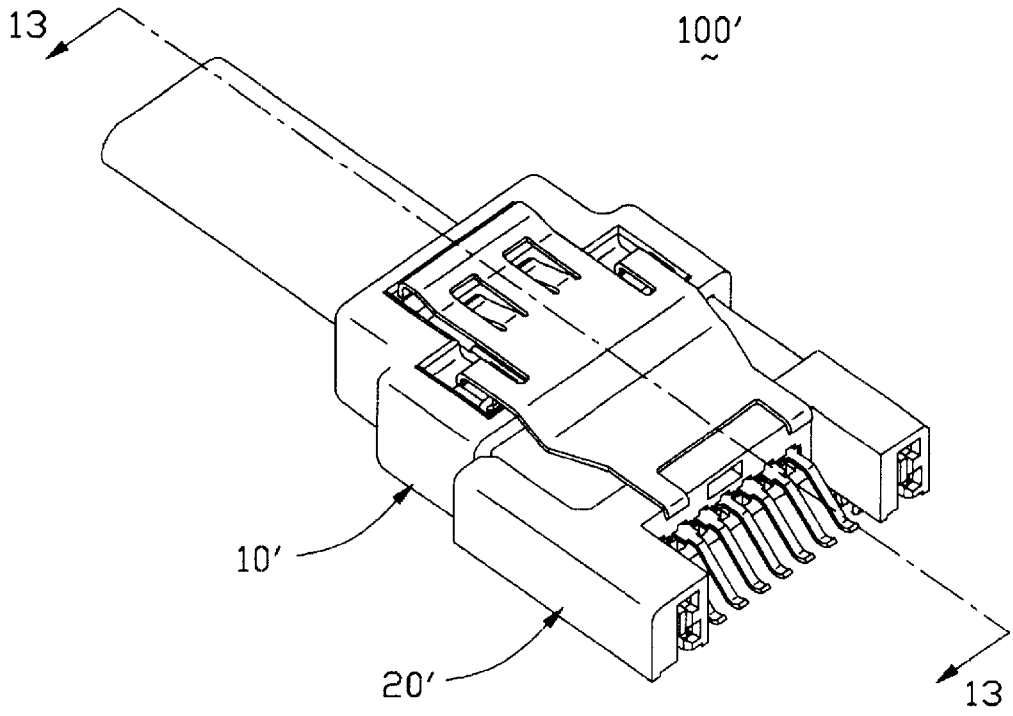
FIG. 12 is an assembled view of FIG. 1.
Figure 13:
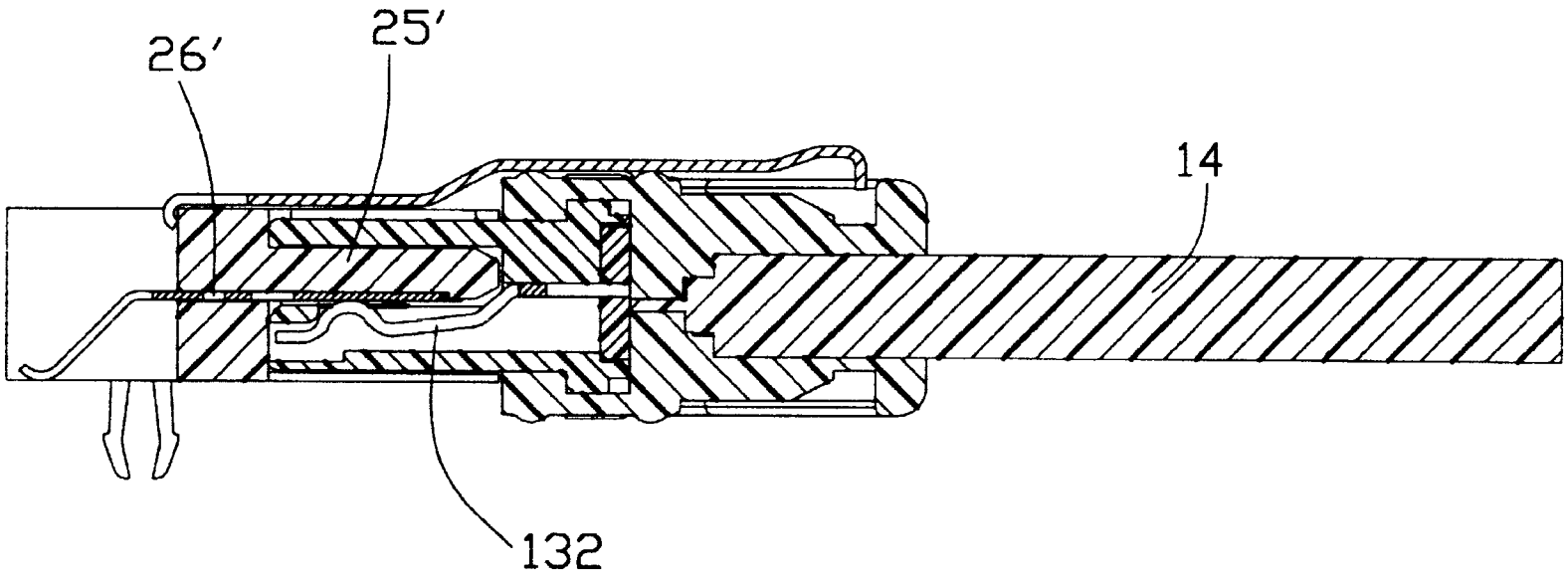
FIG. 13 is a cross-sectional view taken along line 13—13 of FIG. 12.

Referring to FIGS. 11, 12 and 13, an electrical connector assembly in accordance with a second embodiment comprises a second cable end connector and a second complementary connector 20'. The second cable end connector 10' has a same construction as that of the cable end connector 10 described in the first embodiment except that the second cable end connector 10' only has one locking member. The second complementary connector 20' has a same construction as that of the complementary connector 20 in the first embodiment except the base portion 22' and the terminals 26'. The base portion 22' has a pair of rear portion extending rearwardly from a rear surface of the base portion 22'. Each terminal 26' has a tail portion extending beyond the rear surface of the base and bent downwardly for being surface mounted to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the distal end of the locking section 168 may be further equipped with an oblique guiding section for easy assembling between the mated connectors.

What is claimed is:

1. A cable end connector for mating with a complementary connector, comprising:

a housing defining a retention portion on an upper surface thereof;

a plurality of contacts mounted in the housing;

a cable having a plurality of conductors electrically connecting the contacts;

a cover over-molded with and enclosing a rear end of the housing; and a locking member having a main portion abutting against a plate of the cover, a latch portion extending from the main portion and latching with the retention portion of the housing, and a locking portion extending forwardly from the main portion and adapted to lock with the complementary connector for providing a mechanical connection therebetween.

2. The cable end connector as claimed in claim 1, wherein the locking member comprises a push portion extending rearwardly and upwardly from the main portion thereof, the push portion has a contact portion extending downwardly therefrom.

3. The cable end connector as claimed in claim 2, wherein a recess is defined in the plate of the cover to receive the contact portion of the locking member when the push portion is pushed downwardly.

4. The cable end connector as claimed in claim 2, wherein a pair of tabs extends downwardly from the main portion of the locking member and abuts against the plate of the cover for providing spring force to the push portion of the locking member to resume to an original position.

5. The cable end connector as claimed in claim 1, wherein a receiving hole is defined in the plate of the cover and the retention portion extends into the receiving hole, the latching portion of the locking member mechanically engages with the retention portion.

6. The cable end connector as claimed in claim 5, wherein the latching portion has an engaging portion extends downwardly and is bent forwardly therefrom, a retention hole is defined in the retention portion, the engaging portion of the latching portion is correspondingly received in the retention hole of the retention portion.

7. The cable end connector as claimed in claim 1, wherein a first rib protrudes upwardly from the plate of cover and adjacent to a front end of the cover, the first rib supports the locking member and function as a fulcrum when the tab works.

8. The cable end connector as claimed in claim 1, wherein a second rib protrudes upwardly from a middle of the plate of the cover, the second rib supports the locking member and functions as a fulcrum when the push portion is pushed downwardly.

9. The cable end connector as claimed in claim 1, wherein the connector further comprises a contact insert, the plurality of contacts is insert-molded in the contact insert.

10. The cable end connector as claimed in claim 9, wherein the housing comprises an L-shaped receiving space and a block protrudes into the receiving space, a plurality of passageways is defined in the block, the contact insert is assembled to the cover and the contacts are received into the passageways and partly exposed to the receiving space.

11. The cable end connector as claimed in claim 1, wherein a guide projection protrudes sidewardly from a side surface of the housing for complementing with a corresponding guiding portion of the complementary connector.

12. The cable end connector as claimed in claim 1, wherein the locking portion comprises a plate portion extending forwardly from the main portion and a pair of locking sections extending forwardly from the plate portion for locking with the complementary connector.

13. The cable end connector as claimed in claim 5, wherein the latching portion is a pair of claws locating at a pair of opposite ends of the main portion.

14. The cable end connector as claimed in claim 13, wherein the receiving hole of the cover is a pair of through holes separately defined in opposite sides of the first and second ribs of the upper plate.

15. The cable end connector as claimed in claim 14, wherein the retention portion is a pair of projecting blocks which protrudes upwardly from the upper surface of the housing and are respectively received into the through holes of cover.

16. An electrical connector assembly adapted for being mounted on a printed circuit board, comprising:

a cable end connector comprising a housing defining a receiving space, a plurality of contacts mounted in the receiving space, a cable having a plurality of conductors electrically connecting the contacts, a cover enclosing a rear end of the housing, a locking member having a main portion abutting against a top plate of the cover, a latch portion extending from the main portion and latching with the housing, and a locking portion extending forwardly from the main portion;

a complementary connector having a base portion and a tongue portion extending forwardly from the base portion and respectively received into the receiving space of the cable end connector, a plurality of terminals received into the tongue portion and respectively electrically contacting the contacts of the cable end connector;

wherein the locking portion of the locking member respectively lock with the base portion of the complementary connector for providing a mechanical connection between the cable end connector and the complementary connector.

17. The electrical connector assembly as claimed in claim 16, wherein the locking portion locks and abuts against a rear surface of the base portion of the complementary connector.

18. The electrical connector assembly as claimed in claim 16, wherein the cable end connector comprises a guiding projection protruding from a side surface of the housing, the base portion of the complementary connector has a guiding post locating at a side thereof, the guiding projection is respectively received into the guiding post.

19. An electrical connector assembly comprising:

a receptacle connector mounted on a printed circuit board, said receptacle connector including a base portion and a tongue portion extending from and perpendicular to said base portion;

a plurality of terminals received in the tongue portion;

a cable end connector connected to a cable at a rear end thereof, and including an insulative housing defining a longitudinal direction thereof and a receiving space therein, a plurality of contacts disposed in the housing and respectively electrically connected to corresponding conductors of the cable;

a cover enclosing a rear portion of the cable end connector; and at least one locking member pivotally fastened to at least one of said cover and said housing, said locking member defining a moveable locking end thereof; wherein when mated, the tongue portion is received in the receiving space with the contacts and the terminals mechanically and electrically engaged with each other, and locking end of the locking member is latchably engaged with the base portion close to the printed circuit board.

20. The assembly as claimed in claim 19, wherein said locking end is located behind the base portion along a mating direction of said cable end connector and said receptacle connector.

21. The assembly as claimed in claim 19, wherein said locking member generally extends on a plane parallel to the longitudinal direction.

22. The assembly as claimed in claim 21, wherein said cable end connector is provided with another locking member opposite to said locking member with the housing therebetween.

* * * * *